US005975254A

United States Patent [19]

Emilsson

[11] Patent Number: 5,975,254

[45] Date of Patent: Nov. 2, 1999

[54] SEALING ARRANGEMENT FOR A RAIL VEHICLE SLACK ADJUSTER

[75] Inventor: Fred Emilsson, Trelleborg, Sweden

[73] Assignee: SAB Wabco AB, Landskrona, Sweden

[21] Appl. No.: 08/977,608

[22] Filed: Nov. 25, 1997

[30] Foreign Application Priority Data

Nov. 25, 1996 [SE] Sweden ..... 9604312

[51] Int. Cl.[6] ..... F16J 15/16

[52] U.S. Cl. ..... 188/196 R; 277/412; 188/198

[58] Field of Search ..... 188/196 R, 197, 188/198, 199, 200, 201, 202, 322.12, 322.17, 322.16; 74/18.2; 403/360; 277/412, 356, 423, 503

[56] References Cited

U.S. PATENT DOCUMENTS

| | | | |
|---|---|---|---|
| 5,025,900 | 6/1991 | Severinsson | 188/198 |
| 5,476,269 | 12/1995 | Karlsson | 188/198 |
| 5,615,755 | 4/1997 | Karlsson | 188/198 |

*Primary Examiner*—Douglas C. Butler
*Attorney, Agent, or Firm*—Laurence R. Brown

[57] ABSTRACT

In a sealing arrangement between a tubular housing (2) and a rod (1) in a rail vehicle slack adjuster, a cup (3) is movable with the rod and extends along the rod over the free end of the housing. A sealing arrangement (6–9) is in sealing engagement with the housing (2). It comprises flange-like portions (6', 7), extending into close proximity with the inner wall of the cup for forming a labyrinth seal, and a sealing lip (9') in sealing contact with the end of the cup for preventing the intrusion of water and the like in the cup.

5 Claims, 1 Drawing Sheet

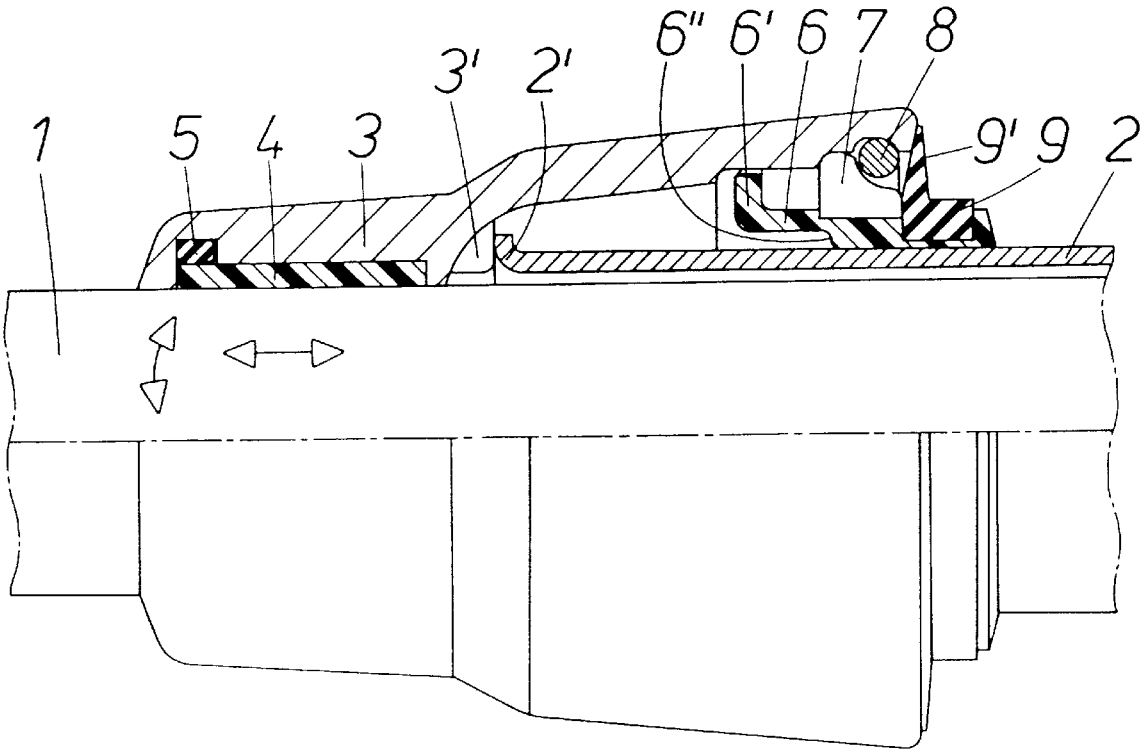
1
5
4
3
3'
2'
6''
6'
6
7
8
9'
9
2

SEALING ARRANGEMENT FOR A RAIL VEHICLE SLACK ADJUSTER

TECHNICAL FIELD

This invention relates to a sealing arrangement, particularly for a rail vehicle slack adjuster, between a generally tubular housing and a rod, which is axially and rotatably movable relative thereto, wherein a cup sealingly engaging the rod at a first end is movable with the rod, has a greater inner diameter than the outer diameter of the rod and extends along the rod over the free end of the housing.

BACKGROUND OF THE INVENTION

As is well known to any person skilled in the art, there are both axial and rotational movements between the rod or spindle and housing or barrel of a conventional rail vehicle slack adjuster of the axial type at each and every brake operation. This means that the required sealing between the rod and the housing is exposed to great wear, not the least in view of the extremely harsh environment underneath a rail vehicle, where the slack adjuster is mounted.

A very conventional sealing in the housing may consist of one or more internal sealing rings engaging the rod. These sealing rings may be made of a plastic material in order to withstand the wear better than rubber rings. The result is, however, not satisfactory in some instances when the sealing after a certain period of operation is not tight any more and allows water and contaminants to enter the interior of the slack adjuster resulting in rust problems and eventually function disturbances.

A solution to the above problems was presented in EP-B-353 796, to which reference is made for a full understanding.

The sealing arrangement proposed therein has been used in practice for a period of time and has generally speaking proved advantageous, especially with regard to the possibility for water or moist introduced in the cup in any way to leave it. However, a special problem is that the sealing arrangement is sometimes exposed to forceful water sprays, for example when the undercarriage of the vehicle is cleaned. Generally speaking, the object of the invention is to improve the ability of the sealing arrangement defined above to prevent the intrusion of water, moist, dirt and the like, whilst allowing water in the cup to leave it.

THE INVENTION

According to the invention, a sealing arrangement, provided in the cup at its second end, is in sealing engagement with the housing and comprises flange-like portions, extending into close proximity with the inner wall of the cup for forming a labyrinth seal, and a sealing lip in sealing contact with the end of the cup for preventing the intrusion of water and the like in the cup.

THE DRAWING

The invention will be described in further detail below reference being made to the accompanying drawing, in which the single FIGURE is a side view, partly in section, of a sealing arrangement according to the invention.

DETAILED DESCRIPTION OF A PREFERRED EMBODIMENT

In a conventional rail vehicle slack adjuster of the so called axial type a circular rod or spindle 1 is intended to move axially back and forth but also to rotate relative to a substantially tubular housing or barrel 2, as is well known to any person skilled in the art.

In a sealing arrangement according to the invention the housing 2 is at its end provided with a circumferential flange 2' for a purpose to be described. A cup 3 surrounds the end of the housing 2. At its forward end (to the left in the FIGURE) the cup 3 is provided with a sealing consisting of a slitted sealing bushing 4, preferably made of plastic, and a rubber O-ring 5, backing the sealing bushing 4. Hereby the cup 3 will be sealingly guided for movements back and forth on the rod 1 without causing undue wear.

At the other end (to the right in the FIGURE) of the cup 3 there is provided a sealing arrangement according to the invention.

In sealing contact with the tube 2 but allowing relative axial movements is a sleeve 6, which is divided into two parts for permitting mounting and preferably is made of plastic. At its end projecting into the cup 3 the sleeve 6 is provided with a radial flange 6', which extends close to but not in contact with the inner wall of the cup 3. Integral with the sleeve 6 is a sleeve ring 7. Also the sleeve ring 7 extends close to but not in contact with the inner wall of the cup 3. Both the radial flange 6' and the sleeve ring 7 may be provided with circumferential notches, which are staggered in relation to each other; the shown section is through a notch in the sleeve ring 7.

A spring circlip 8 is arranged in a circumferential groove in the cup 3 for holding the sleeve 6 with the sleeve ring 7 in proper position in relation to the cup 3.

A collar 9, preferably made of rubber, is arranged in an end groove in the sleeve 6. The collar 9 is provided with a sealing lip 9' in elastic contact with the end of the cup 3.

The function of the flange 2' is primarily to set the limits for the relative axial movements between the tube 2 and the cup 3. At its movement to the left in the drawing the tube flange 2' will reach heads 3' in the cup 3 and at continued leftward movement push the cup 3 to the left. At its movement to the right the flange 2' will reach a circumferential shoulder 6" on the sleeve 6 and at continued rightward movement push the cup 3 to the right via the ring 7 and the locking ring 8.

The improved sealing of the described arrangement relies on the double labyrinth function of the flange 6' and the sleeve ring 7 in relatively close proximity to the inner wall of the cup 3 as well as the function of the sealing lip 9' to allow possibly condensed water to leave the interior of the cup 3 but at the same time preventing water from entering this interior, which is especially critical, when water at high pressure is sprayed at the underframe of a rail vehicle for cleaning purposes.

I claim:

1. A sealing arrangement, for a rail vehicle slack adjuster, between a generally tubular housing with a free end and closed end (2) and a rod (1), which is axially and rotatably movable relative thereto, wherein a cup (3) sealingly engaging the rod is movable with the rod, has a greater inner diameter than outer diameter of the rod and extends along the rod over the free end of the housing, characterized in that the sealing arrangement (6–9), provided in the cup (3) at its closed end, is in sealing engagement with the housing (2) and comprises flange-like portions (6', 7), extending into close proximity with an inner wall of the cup for forming a labyrinth seal, and a sealing lip (9') in sealing contact with the closed end of the cup for preventing the intrusion of water in the cup.

2. An arrangement according to claim 1, characterized in that the sealing arrangement comprises a sleeve (6), which has two flange-like portions (6', 7), and a collar (9), provided with the sealing lip (9'), in a groove in the sleeve.

3. An arrangement according to claim 2, characterized in that the sleeve (6) is provided with a radial flange (6') and a sleeve ring (7).

4. An arrangement according to claim 3, characterized in that the sleeve (6) is divided into two parts for permitting mounting.

5. An arrangement according to claim 1, characterized in that the sealing arrangement (6–9) is held in position by a spring circlip (8) in the end of the cup (3).

* * * * *